US010714859B2

(12) United States Patent
Huang et al.

(10) Patent No.: US 10,714,859 B2
(45) Date of Patent: Jul. 14, 2020

(54) RECEPTACLE ELECTRICAL CONNECTOR

(71) Applicant: Advanced Connectek Inc., New Taipei (TW)

(72) Inventors: Fan-Cheng Huang, New Taipei (TW); Ying-Te Lin, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 16/045,778

(22) Filed: Jul. 26, 2018

(65) Prior Publication Data

US 2019/0044268 A1 Feb. 7, 2019

(30) Foreign Application Priority Data

Aug. 1, 2017 (TW) ..... 106211323 U

(51) Int. Cl.

| | |
|---|---|
| ***H01R 24/00*** | (2011.01) |
| ***H01R 13/424*** | (2006.01) |
| ***H01R 24/78*** | (2011.01) |
| ***H01R 13/6585*** | (2011.01) |
| ***H01R 24/60*** | (2011.01) |
| ***H01R 13/41*** | (2006.01) |
| ***H01R 13/506*** | (2006.01) |
| *H01R 107/00* | (2006.01) |
| *H01R 12/70* | (2011.01) |
| *H01R 12/72* | (2011.01) |
| *H01R 13/6594* | (2011.01) |

(52) U.S. Cl.

CPC ..... *H01R 13/424* (2013.01); *H01R 13/41* (2013.01); *H01R 13/506* (2013.01); *H01R 13/6585* (2013.01); *H01R 24/60* (2013.01); *H01R 24/78* (2013.01); *H01R 12/707* (2013.01); *H01R 12/724* (2013.01); *H01R 13/6594* (2013.01); *H01R 2107/00* (2013.01)

(58) Field of Classification Search

CPC ..... H01R 23/7073; H01R 23/7005; H01R 13/2442

USPC ..... 439/660, 626, 374, 377, 79, 733

See application file for complete search history.

(56) References Cited

U.S. PATENT DOCUMENTS

2016/0118750 A1* 4/2016 Guo ..... H01R 13/6585 439/78

* cited by examiner

*Primary Examiner* — Phuong Chi Thi Nguyen
(74) *Attorney, Agent, or Firm* — JCIPRNET

(57) ABSTRACT

A receptacle electrical connector includes a plurality of first terminals, a plurality of second terminals, a main insulator, a secondary insulator, a shielding plate and a shielding shell. The main insulator has a plurality of first terminal grooves and a plurality of second terminal grooves. Each first terminal accommodated in the corresponding first terminal groove is fitted with the corresponding first terminal groove in interference and in face-to-face contact. Each second terminal accommodated in the corresponding second terminal groove is fitted with the corresponding second terminal groove in interference and in face-to-face contact. The secondary insulator is engaged with the main insulator to limit each first terminal in the corresponding first terminal groove and to limit each second terminal in the corresponding second terminal groove. The shielding plate is located between the first terminals and the second terminals. The shielding shell surrounds the main insulator.

14 Claims, 8 Drawing Sheets

RECEPTACLE ELECTRICAL CONNECTOR

CROSS-REFERENCE TO RELATED APPLICATION

This application claims the priority benefit of Taiwan patent application serial no. 106211323, filed on Aug. 1, 2017. The entirety of the above-mentioned patent application is hereby incorporated by reference herein and made a part of the specification.

BACKGROUND OF THE INVENTION

Field of the Invention

The invention is related to an electrical connector, and particularly to a receptacle electrical connector.

Description of Related Art

Electrical connector is a common electronic component of electronic devices, capable of being connected to matching electrical connectors of other electronic devices and further enabling signal and electricity transmission between two electronic devices. One of the existing electrical connectors, for example, a universal serial bus (USB) electrical connector with newly added electrical connector Type C specification, is capable of not only transmitting data at an ultra speed, 10 Gbps, but also being plugged upright or upside down due to the symmetrical port. Such electrical connector is thus commonly applied on a variety of electronic devices such as a notebook computer.

A receptacle electrical connector with USB Type C specification has a larger number of components and the components are smaller in size. For the receptacle electrical connector that is assembled via insertion, a terminal thereof can be fixed in a corresponding groove of an insulator via a barb, which requires sufficient structural thickness between two grooves, otherwise the structure between the two grooves can be easily damaged by the barb. If the structure between the two grooves is seriously damaged, improper electrical conduction may occur between adjacent terminals.

SUMMARY OF THE INVENTION

The invention provides a receptacle electrical connector provided to be installed within an electronic device to be connected with a matching plug electrical connector.

A receptacle electrical connector of the invention includes a plurality of first terminals, a plurality of second terminals, a main insulator, a secondary insulator, a shielding plate and a shielding shell. The main insulator has a plurality of first terminal grooves and a plurality of second terminal grooves. Each first terminal accommodated in a corresponding first terminal groove is fitted with the corresponding first terminal groove in interference and in face-to-face contact. Each second terminal accommodated in a corresponding second terminal groove is fitted with the corresponding second terminal groove in interference and in face-to-face contact. The secondary insulator is engaged with the main insulator to limit each first terminal in the corresponding first terminal groove, and limit each second terminal in the corresponding second terminal groove. The shielding plate is located between the first terminals and the second terminals. The shielding shell surrounds the main insulator.

In an embodiment of the invention, each first terminal has a first side protrusion. The first side protrusion protrudes toward an adjacent first terminal, and each first terminal is fitted with the corresponding first terminal groove in interference and in face-to-face contact via the corresponding first side protrusion.

In an embodiment of the invention, each first terminal has a first soldering segment, a first connecting segment and a first contacting segment. The first connecting segment connects a corresponding first soldering segment with a corresponding first contacting segment, and the first side protrusion protrudes from a corresponding first connecting segment.

In an embodiment of the invention, each second terminal has a second side protrusion. The second side protrusion protrudes toward an adjacent second terminal, and each second terminal is fitted with the corresponding second terminal groove in interference and in face-to-face contact via the corresponding second side protrusion.

In an embodiment of the invention, each second terminal has a second soldering segment, a second connecting segment and a second contacting segment. The second connecting segment connects a corresponding second soldering segment with a corresponding second contacting segment, and the second side protrusion protrudes from a corresponding second connecting segment.

In an embodiment of the invention, a first convex end of each first terminal is tapered and a first concave end of each first terminal groove is tapered so as to accommodate the corresponding first convex end of the first terminal.

In an embodiment of the invention, the first convex end of each first terminal is tapered toward the shielding plate, and the first concave end of each first terminal groove is tapered toward the shielding plate.

In an embodiment of the invention, each first terminal has a first surface protrusion, and each first surface protrusion protrudes from a surface of the corresponding first terminal in a direction away from the shielding plate, such that each first terminal is close to a bottom portion of the corresponding first terminal groove so as to ensure that the corresponding first convex end of the first terminal is aligned with the corresponding first concave end of the first terminal groove.

In an embodiment of the invention, a second convex end of each second terminal is tapered and a second concave end of each second terminal groove is tapered so as to accommodate the corresponding second convex end of the second terminal.

In an embodiment of the invention, the second convex end of each second terminal is tapered toward the shielding plate, and the second concave end of each second terminal groove is tapered toward the shielding plate.

In an embodiment of the invention, each second terminal has a second surface protrusion, and each second surface protrusion protrudes from a surface of the corresponding second terminal in a direction away from the shielding plate, such that each second terminal is close to a bottom portion of the corresponding second terminal groove so as to ensure that the corresponding second convex end of the second terminal is aligned with the corresponding second concave end of the second terminal groove.

In an embodiment of the invention, the main insulator further includes an engaging recess and a pair of main locking portions. The secondary insulator further includes a pair of secondary locking portions. After the secondary insulator is engaged with the engaging recess, the pair of secondary locking portions is locked with the pair of main locking portions respectively so as to fix a position of the secondary insulator relative to the main insulator.

In an embodiment of the invention, the main insulator further includes a pair of main limiting portions. The secondary insulator further includes a pair of secondary limiting portions. In the process that the secondary insulator is engaged with the engaging recess, the pair of secondary limiting portions are brought into contact with the pair of main limiting portions respectively so as to limit the position of the secondary insulator relative to the main insulator.

In an embodiment of the invention, each first terminal has a first soldering segment, and each second terminal has a second soldering segment. The first soldering segments are extended from the secondary insulator and arranged in a single line, and the second soldering segments are extended from the secondary insulator and arranged in a plurality of lines.

An embodiment of the invention further includes a shielding cover installed on the shielding shell.

In summary, in the invention, by fitting each terminal with the corresponding terminal groove in interference and in face-to-face contact, the terminal is fixed in the terminal groove, and damage to the structure between terminal grooves can be avoided, thereby increasing the structural width between terminal grooves and reducing the width of terminals.

In order to make the aforementioned features and advantages of the invention more comprehensible, embodiments accompanying figures are described in detail below.

DESCRIPTION OF EMBODIMENTS

Figure 1A:
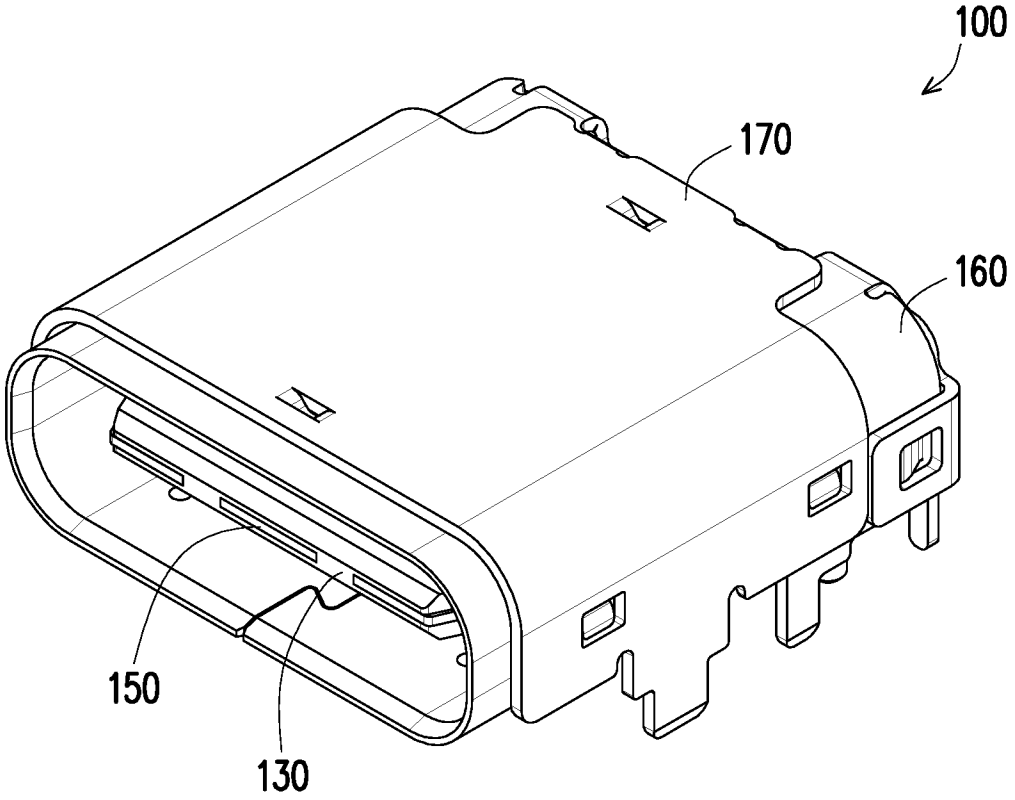
FIG. 1A and FIG. 1B are three-dimensional views respectively illustrating a receptacle electrical connector in different viewing angles according to an embodiment of the invention.

Referring to FIG. 1A, FIG. 1B, FIG. 2A and FIG. 2B, in the embodiment, a receptacle electrical connector 100 may comply with the USB TYPE-C specification, which should not be construed as a limitation to the invention. The receptacle electrical connector 100 includes a plurality of first terminals 110, a plurality of second terminals 120, a main insulator 130, a secondary insulator 140, a shielding plate 150 and a shielding shell or a metallic shell 160. The main insulator 130 has a plurality of first terminal grooves 131 and a plurality of second terminal grooves 132. Each first terminal 110 accommodated in the corresponding first terminal groove 131 is fitted with the corresponding first terminal groove 131 in interference and in face-to-face contact. Each second terminal 120 accommodated in the corresponding second terminal groove 132 is fitted with the corresponding second terminal groove 132 in interference and in face-to-face contact. The secondary insulator 140 which is an organizer is engaged with the main insulator 130 so as to limit each first terminal 110 in the corresponding first terminal groove 131, and limiting each second terminal 120 in the corresponding second terminal groove 132. The shielding plate 150 is located between the first terminals 110 and the second terminals 120. The shielding shell 160 surrounds the main insulator 130.

Figure 2A:
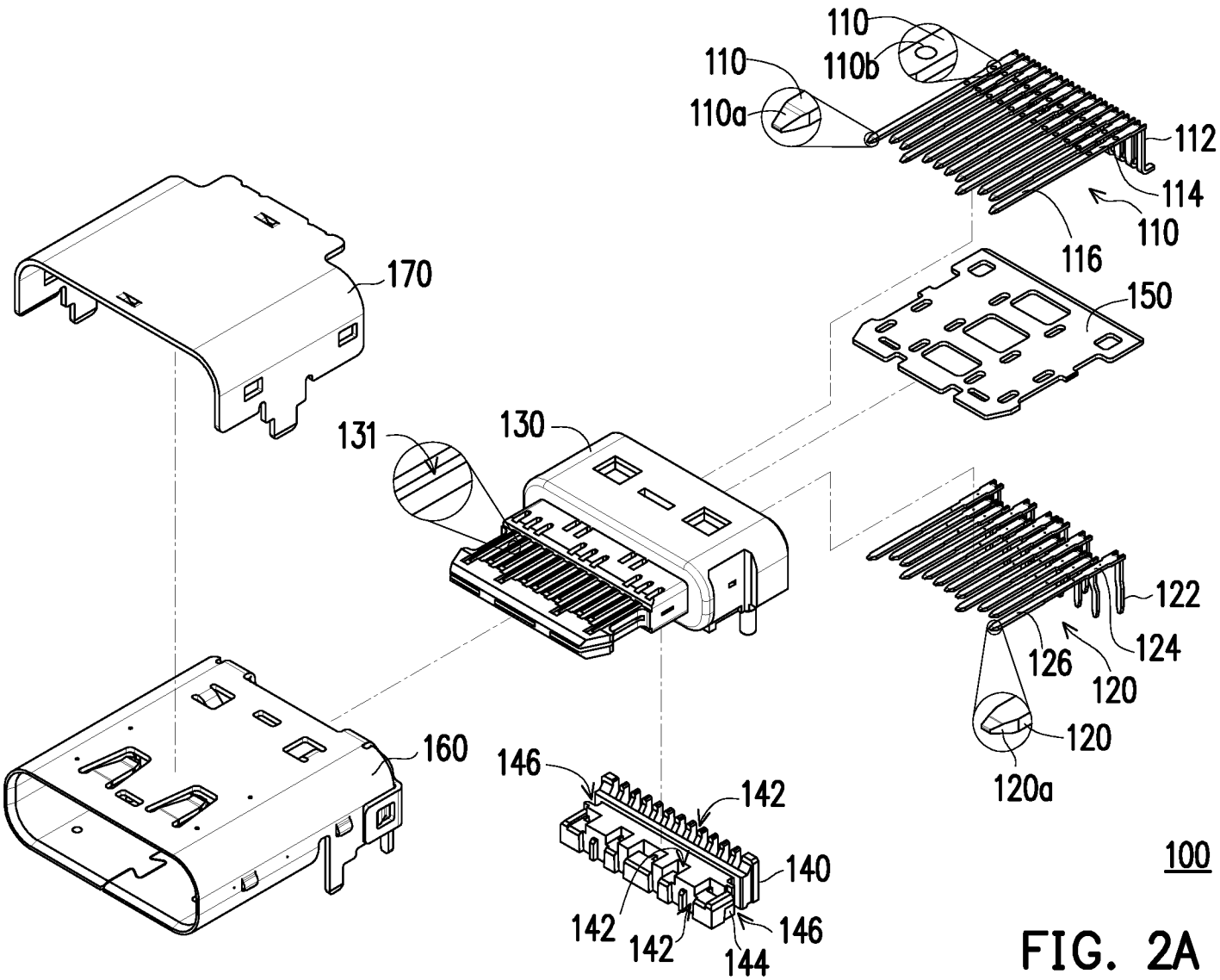
FIG. 2A and FIG. 2B are exploded views respectively illustrate the receptacle electrical connector in FIG. 1A in different viewing angles.
Figure 2B:
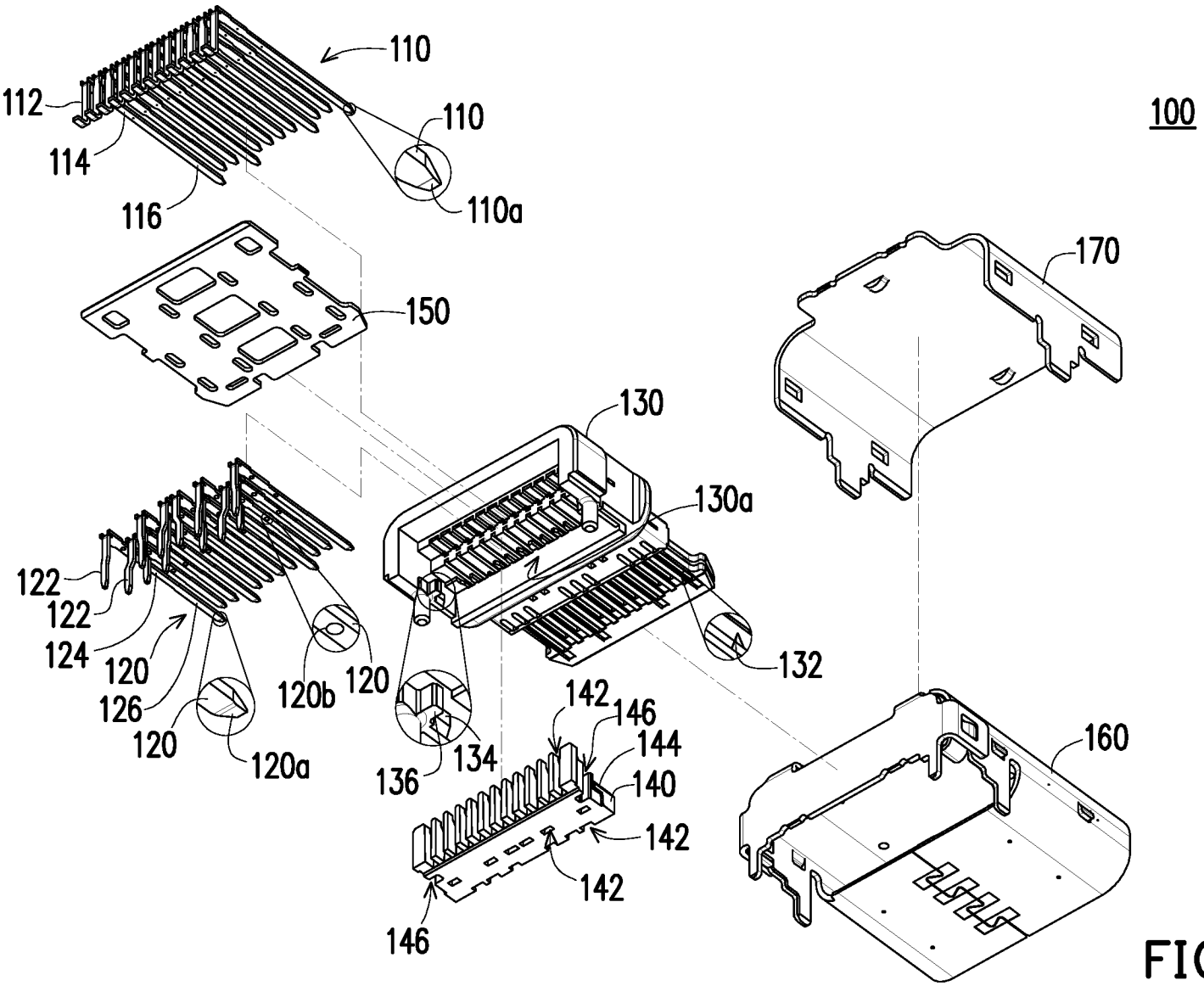

Referring to FIG. 2A and FIG. 2B, in the embodiment, each first terminal 110 accommodated in the corresponding first terminal groove 131 is fitted with the corresponding first terminal groove 131 in interference and in face-to-face contact. Therefore, the first terminals 110 do not damage the first terminal grooves 131, such that the structural width between two adjacent first terminal grooves 131 can be increased correspondingly, and the width of each first terminal 110 can be reduced correspondingly. Likewise, each second terminal 120 accommodated in the corresponding second terminal groove 132 is fitted with the corresponding second terminal groove 132 in interference and in face-to-face contact. Therefore, the second terminals 120 do not damage the second terminal grooves 132, such that the structural width between two adjacent second terminal grooves 132 can be increased correspondingly, and the width of each second terminal 120 can be reduced correspondingly.

Figure 3:
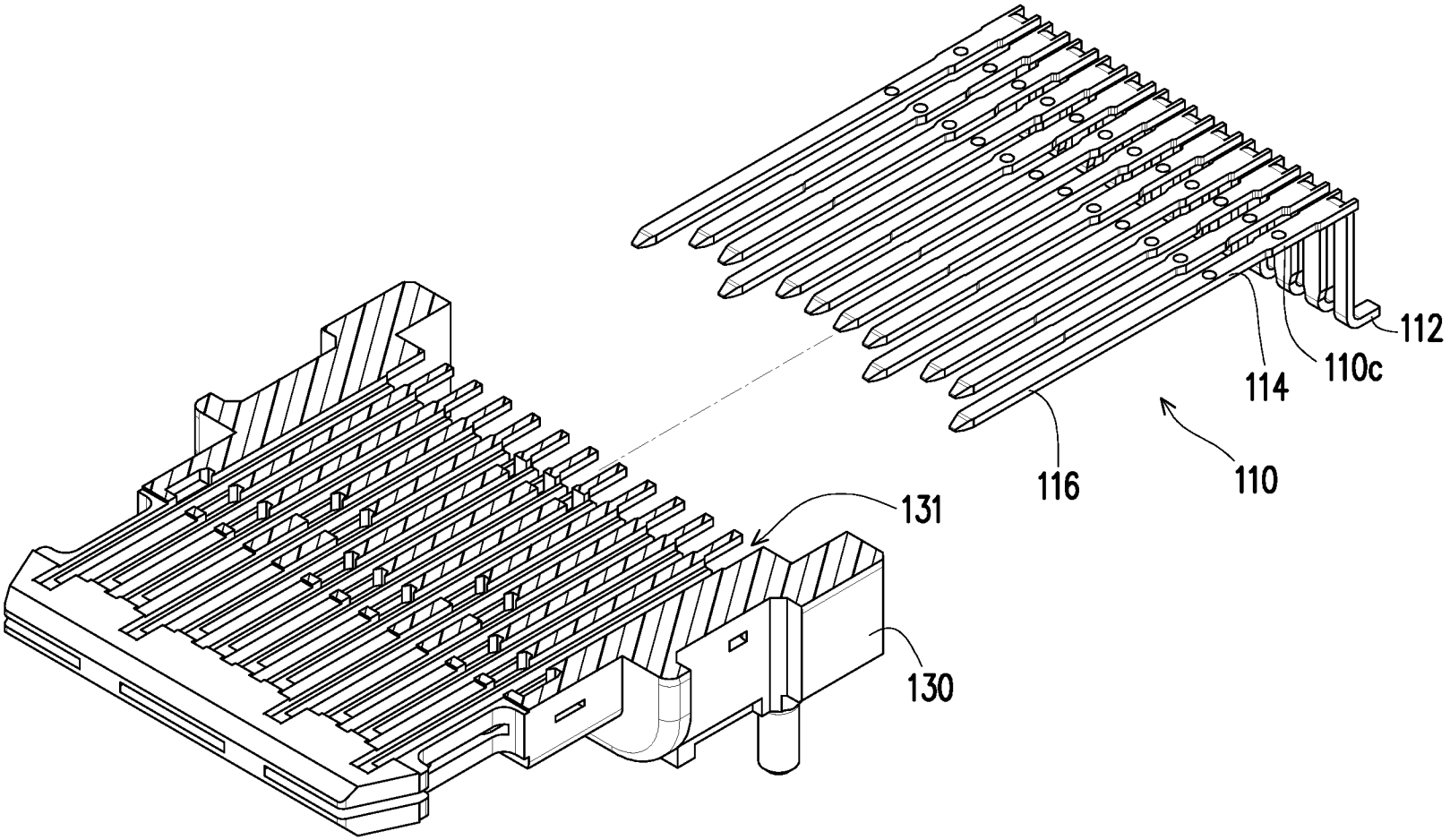
FIG. 3 is a three-dimensional view illustrating the first terminals and the main insulator being partially cut away in FIG. 2A.

Referring to FIG. 2A and FIG. 3, in the embodiment, each first terminal 110 has a first side protrusion 110*c*. The first side protrusion 110*c* protrudes toward the adjacent first terminal 110, and each first terminal 110 is fitted with the corresponding first terminal groove 131 in interference and in face-to-face contact via the corresponding first side protrusion 110*c*. In the embodiment, each first terminal 110 has a first soldering segment 112, a first connecting segment 114 and a first contacting segment 116. The first connecting segment 114 connects the corresponding first soldering segment 112 with the corresponding first contacting segment 116, and the first side protrusion 110*c* may protrude from the corresponding first connecting segment 114.

Figure 4:
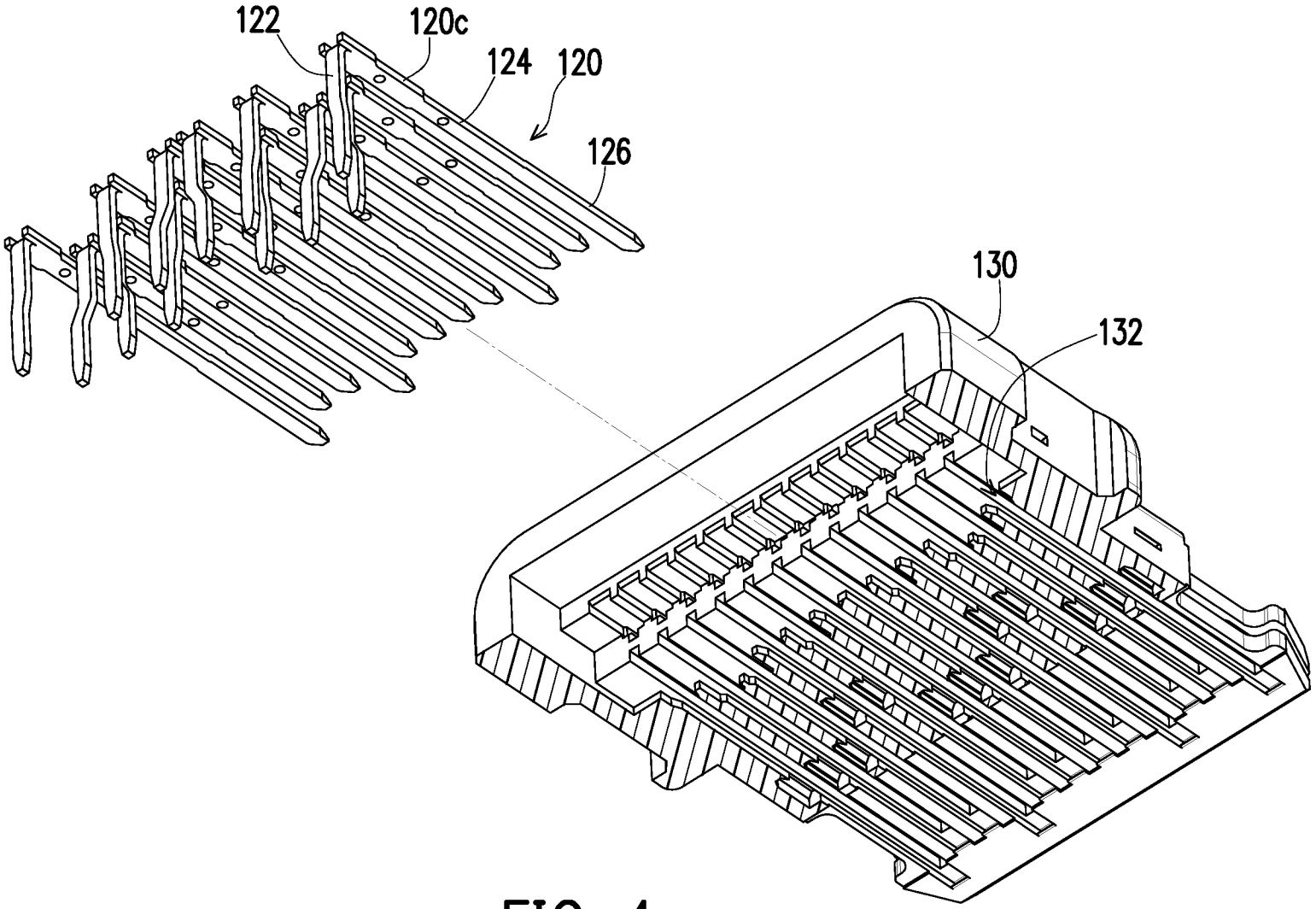
FIG. 4 is a three-dimensional view illustrating the second terminals and the main insulator being partially cut away in FIG. 2B.

Referring to FIG. 2B and FIG. 4, in the embodiment, each second terminal 120 has a second side protrusion 120*c*. The second side protrusion 120*c* protrudes toward the adjacent second terminal 120, and each second terminal 120 is fitted with the corresponding second terminal groove 132 in interference and in face-to-face contact via the corresponding second side protrusion 120*c*. In the embodiment, each second terminal 120 has a second soldering segment 122, a second connecting segment 124 and a second contacting segment 126. The second connecting segment 124 connects the corresponding second soldering segment 122 with the corresponding second contacting segment 126, and the second side protrusion 120 may protrude from the corresponding second connecting segment 124.

Figure 5:
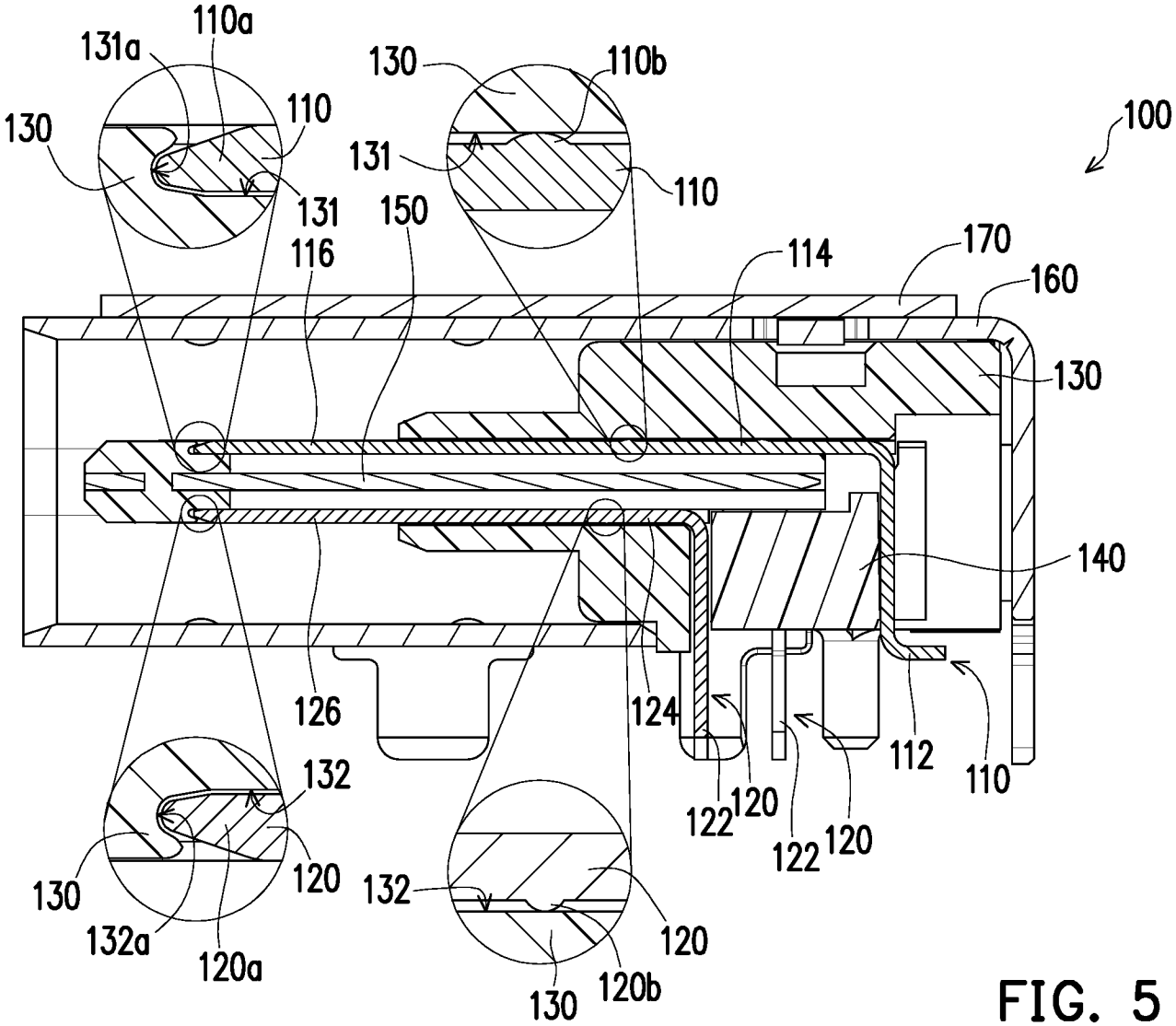
FIG. 5 is a cross-sectional view illustrating the receptacle electrical connector in FIG. 1A taken along the first terminal and the second terminal.

Referring to FIG. 2A and FIG. 5, in the embodiment, a first convex end 110*a* of each first terminal 110 is tapered, and a first concave end 131*a* of each first terminal groove 131 is tapered so as to accommodate the corresponding first convex end 110*a* of the first terminal 110. In addition, the first convex end 110*a* of each first terminal 110 is tapered toward the shielding plate 150, and the first concave end 131*a* of each first terminal groove 131 is tapered toward the shielding plate 150. Each first terminal 110 has a first surface protrusion 110*b*, and each first surface protrusion 110*b* protrudes from a surface of the corresponding first terminal 110 in a direction away from the shielding plate 150, such that each first terminal 110 is close to a bottom portion of the corresponding first terminal groove 131 so as to ensure that the corresponding first convex end 110*a* of the first terminal 110 is aligned with the corresponding first concave end 131*a* of the first terminal groove 131.

Referring to FIG. 2B and FIG. 5, in the embodiment, a second convex end 120*a* of each second terminal 120 is tapered, and a second concave end 132*a* of each second terminal groove 132 is tapered so as to accommodate the corresponding second convex end 120*a* of the second terminal 120. In addition, the second convex end 120*a* of each second terminal 120 is tapered toward the shielding plate 150, and the second concave end 132*a* of each second terminal groove 132 is tapered toward the shielding plate 150. Each second terminal 120 has a second surface protrusion 120*b*, and each second surface protrusion 120*b* protrudes from a surface of the corresponding second terminal 120 in a direction away from the shielding plate 150, such that each second terminal 120 is close to a bottom portion of the corresponding second terminal groove 132 so as to ensure that the corresponding second convex end 120*a* of the second terminal 120 is aligned with the corresponding second concave end 132*a* of the second terminal groove 132.

Figure 6:
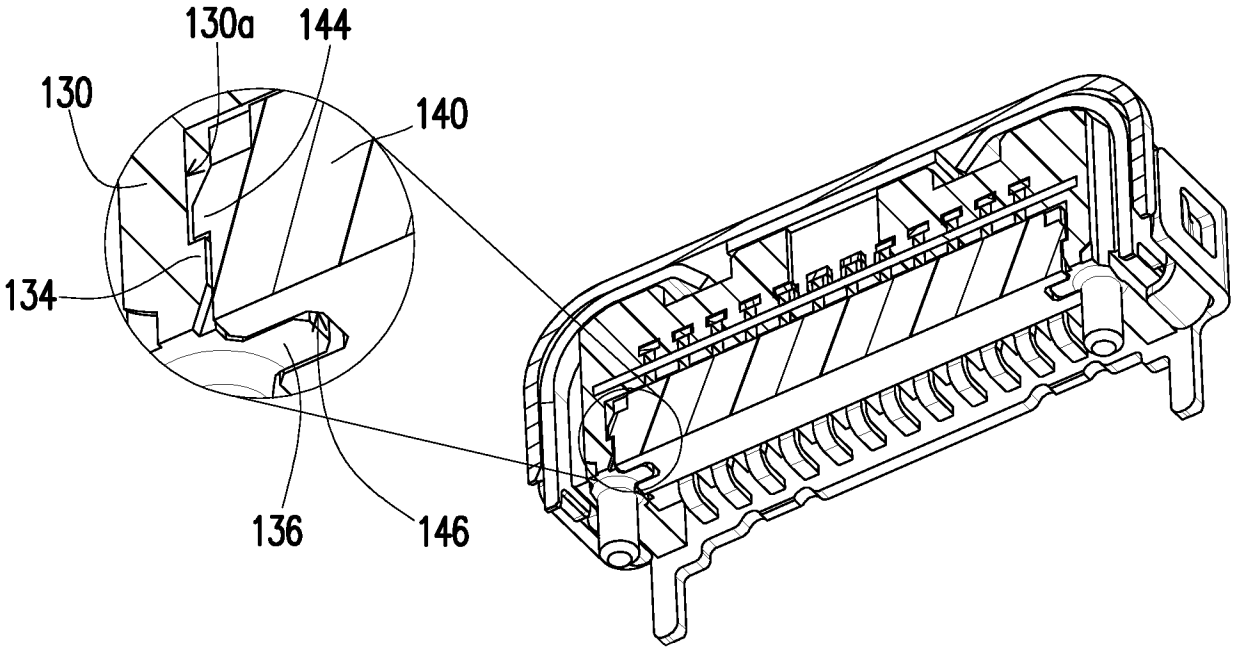
FIG. 6 is a three-dimensional view illustrating the receptacle electrical connector in FIG. 1A taken along the main locking portion and the secondary locking portion.

Referring to FIG. 2A, FIG. 2B and FIG. 6, in the embodiment, the main insulator 130 further has an engaging recess 130*a* and a pair of main locking portions 134. The secondary insulator 140 further has a pair of secondary locking portions 144. After the secondary insulator 140 is engaged with the engaging recess 130*a*, the pair of secondary locking portions 144 is locked with the pair of main locking portions 134 respectively so as to fix a position of the secondary insulator 140 relative to the main insulator 130.

Referring to FIG. 2A, FIG. 2B and FIG. 6, in the embodiment, the main insulator 130 further has a pair of main limiting portions 136. The secondary insulator 140 further has a pair of secondary limiting portions 146. In the process that the secondary insulator 140 is engaged with the engaging recess 130*a*, the pair of secondary limiting portions 146 are respectively brought into contact with the pair of main limiting portions 136 so as to limit the position of the secondary insulator 140 relative to the main insulator 130 until the secondary insulator 140 is engaged with the engaging recess 130*a*. The pair of secondary locking portions 144 is locked with the pair of main locking portions 134 respectively so as to fix the position of the secondary insulator 140 relative to the main insulator 130.

Figure 1B:
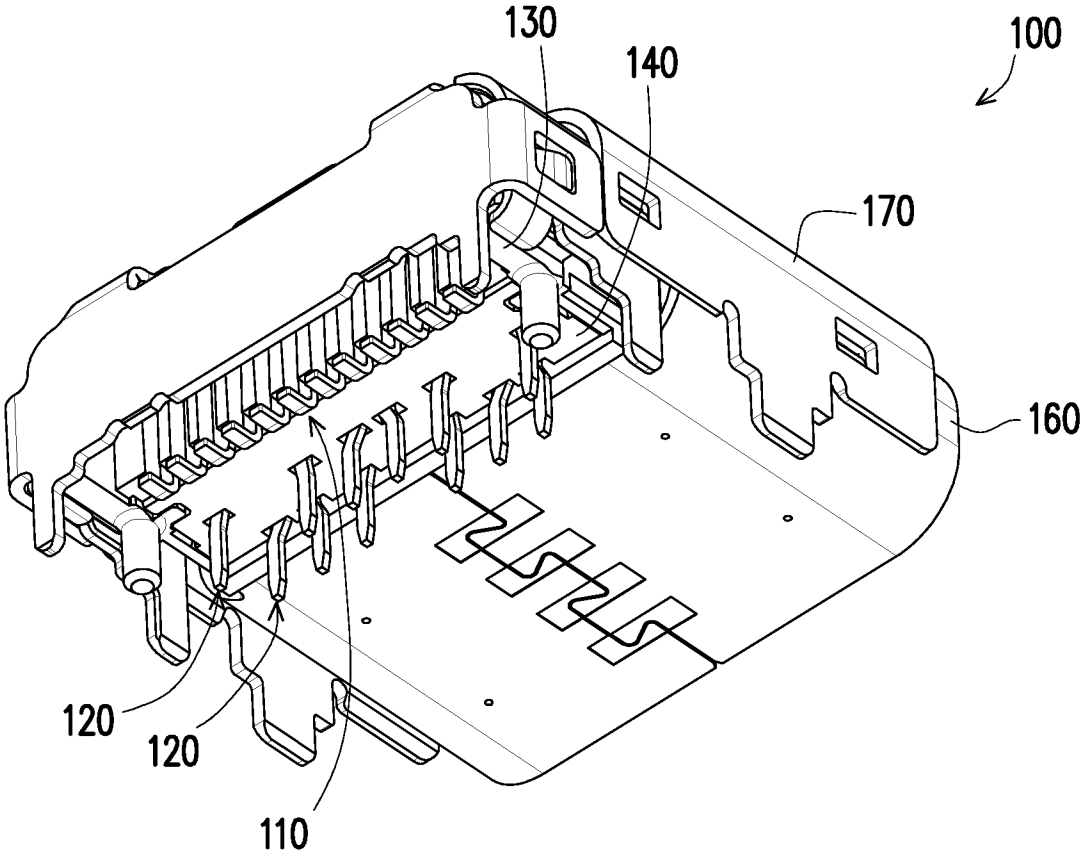

Referring to FIG. 1B and FIG. 2B, in the embodiment, the first soldering segments 112 are extended from the secondary insulator 140 and arranged in a single line. The second soldering segments 122 are extended from the secondary insulator 140 and arranged in a plurality of lines, e.g., two lines.

Referring to FIG. 1A and FIG. 1B, in the embodiment, the receptacle electrical connector further includes a shielding cover 170 installed on the shielding shell 160 to provide additional shielding function.

In summary, in the invention, by fitting each terminal with the corresponding terminal groove in interference and in face-to-face contact, the terminal can be fixed in the terminal groove, and the damage to the structure between terminal grooves can be avoided, thereby increasing the structural width between the terminal grooves and reducing the width of the terminals.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. A receptacle electrical connector, comprising:

a plurality of first terminals;

a plurality of second terminals;

a main insulator, having a plurality of first terminal grooves and a plurality of second terminal grooves, wherein each of the first terminals assembled and accommodated in the corresponding first terminal groove is fitted with the corresponding first terminal groove and in face-to-face contact, each of the second terminals assembled and accommodated in the corresponding second terminal groove is fitted with the corresponding second terminal groove and in face-to-face contact, wherein a first convex end of each of the first terminals is tapered, and a first concave end of each of the first terminal grooves is tapered so as to accommodate the corresponding first convex end of the first terminal, and wherein a second convex end of each of the second terminals is tapered, and a second concave end of each of the second terminal grooves is tapered so as to accommodate the second convex end of the corresponding second terminal;

a secondary insulator, engaged with the main insulator, so as to limit each of the first terminals in the corresponding first terminal groove and limit each of the second terminals in the corresponding second terminal groove;

a shielding plate, disposed between the first terminals and the second terminals; and a shielding shell, surrounding the main insulator.

2. The receptacle electrical connector according to claim 1, wherein the first convex end of each of the first terminals is tapered toward the shielding plate, and the first concave end of each of the first terminal grooves is tapered toward the shielding plate.

3. The receptacle electrical connector according to claim 1, wherein each of the first terminals has a first surface protrusion, and each of the first surface protrusions protrudes from a surface of the corresponding first terminal in a direction away from the shielding plate, such that each of the first terminals is close to a bottom portion of the corresponding first terminal groove so as to ensure that the corresponding first convex end of the first terminal is aligned with the corresponding first concave end of the first terminal groove.

4. The receptacle electrical connector according to claim 1, wherein the second convex end of each of the second terminals is tapered toward the shielding plate, and the second concave end of each of the second terminal grooves is tapered toward the shielding plate.

5. The receptacle electrical connector according to claim 1, wherein each of the second terminals has a second surface protrusion, and each of the second surface protrusions protrudes from a surface of the corresponding second terminal in a direction away from the shielding plate, such that each of the second terminals is close to a bottom portion of the corresponding second terminal groove so as to ensure that the corresponding second convex end of the second terminal is aligned with the corresponding second concave end of the second terminal groove.

6. The receptacle electrical connector according to claim 1, wherein each of the first terminals has a first soldering segment, each of the second terminals has a second soldering segment, the first soldering segments are extended from the secondary insulator and arranged in a single line, and the second soldering segments are extended from the secondary insulator and arranged in a plurality of lines.

7. The receptacle electrical connector according to claim 1, further comprising:

a shielding cover, installed on the shielding shell.

8. The receptacle electrical connector according to claim 1, wherein each of the first terminals is assembled into the corresponding first terminal groove from a back portion of the main insulator so as to limit each of the first terminals fitted with the corresponding first terminal groove and each of the second terminals fitted with the corresponding second terminal groove.

9. The receptacle electrical connector according to claim 1, wherein each of the first terminals has a first side protrusion protruding toward one of the adjacent first terminals, and each of the first terminals is fitted with the corresponding first terminal groove and in face-to-face contact via the corresponding first side protrusion.

10. The receptacle electrical connector according to claim 9, wherein each of the first terminals has a first soldering segment, a first connecting segment and a first contacting segment, the first connecting segment connects the corresponding first soldering segment with the corresponding first contacting segment, and the first side protrusion protrudes from the corresponding first connecting segment.

11. The receptacle electrical connector according to claim 1, wherein each of the second terminals has a second side protrusion protruding toward one of the adjacent second terminals, and each of the second terminals is fitted with the corresponding second terminal groove and in face-to-face contact via the corresponding second side protrusion.

12. The receptacle electrical connector according to claim 11, wherein each of the second terminals has a second soldering segment, a second connecting segment and a second contacting segment, the second connecting segment connects the corresponding second soldering segment with the corresponding second contacting segment, and the second side protrusion protrudes from the corresponding second connecting segment.

13. The receptacle electrical connector according to claim 1, wherein the main insulator further has an engaging recess and a pair of main locking portions, the secondary insulator further has a pair of secondary locking portions, after the secondary insulator is engaged with the engaging recess, the pair of secondary locking portions is locked with the pair of main locking portions respectively so as to fix a position of the secondary insulator relative to the main insulator.

14. The receptacle electrical connector according to claim 13, wherein the main insulator further has a pair of main limiting portions, the secondary insulator further has a pair of secondary limiting portions, in the process that the secondary insulator is engaged with the engaging recess, the pair of limiting portions is in contact with the pair of main limiting portions respectively so as to limit the position of the secondary insulator relative to the main insulator.

* * * * *